US010423120B2

(12) United States Patent
Yamaguchi et al.

(10) Patent No.: US 10,423,120 B2
(45) Date of Patent: Sep. 24, 2019

(54) CARTRIDGE AND IMAGE FORMING APPARATUS HAVING ROLLER SUPPORTED BY ROLLER SUPPORTING PORTIONS

(71) Applicant: CANON KABUSHIKI KAISHA, Tokyo (JP)

(72) Inventors: Koji Yamaguchi, Numazu (JP); Hiroomi Matsuzaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/067,363

(22) PCT Filed: Feb. 16, 2017

(86) PCT No.: PCT/JP2017/006692

§ 371 (c)(1),
(2) Date: Jun. 29, 2018

(87) PCT Pub. No.: WO2017/142099

PCT Pub. Date: Aug. 24, 2017

(65) Prior Publication Data

US 2019/0018363 A1 Jan. 17, 2019

(30) Foreign Application Priority Data

Feb. 18, 2016 (JP) ..... 2016-028494
Feb. 18, 2016 (JP) ..... 2016-028495

(51) Int. Cl.
*G03G 15/02* (2006.01)
*G03G 15/08* (2006.01)
(Continued)

(52) U.S. Cl.
CPC ..... *G03G 21/1821* (2013.01); *G03G 21/1647* (2013.01); *G03G 21/1857* (2013.01); *G03G 15/0275* (2013.01)

(58) Field of Classification Search
CPC ..... G03G 15/0216; G03G 15/0806; G03G 15/1685
(Continued)

(56) References Cited

U.S. PATENT DOCUMENTS 5,943,529 A 8/1999 Miyabe et al.
5,966,567 A 10/1999 Matsuzaki et al.
(Continued)

FOREIGN PATENT DOCUMENTS

EP 0 833 228 A1 4/1998
JP 2001-255717 A 9/2001
(Continued)

OTHER PUBLICATIONS

Written Opinion of the International Searching Authority and International Search Report in PCT/JP2017/006692, dated Jun. 2, 2017.

*Primary Examiner* — William J Royer
(74) *Attorney, Agent, or Firm* — Venable LLP

(57) ABSTRACT

A cartridge includes a photosensitive member, a roller including a core metal shaft and a coating layer, roller supporting portions, and a regulating portion for regulating a position of the roller with respect to a longitudinal direction of the roller. The roller supporting portions are provided so as to support one end portion and an other end potion of the core metal shaft, respectively, with respect to a direction of a rotational axis of the roller. The roller is further provided with cylindrical holes disposed at respective ends of the core metal shaft with respect to the direction of the rotational axis and extending in the direction of the rotational axis with the rotational axis as a center. The roller is supported by the roller supporting portions at inner peripheral surfaces of the holes.

28 Claims, 11 Drawing Sheets

(51) Int. Cl.
*G03G 15/16* (2006.01)
*G03G 21/18* (2006.01)
*G03G 21/16* (2006.01)

(58) Field of Classification Search
USPC ..... 399/176, 279, 313
See application file for complete search history.

(56) References Cited

U.S. PATENT DOCUMENTS 6,011,941 A 1/2000 Takashima et al.
6,097,906 A 8/2000 Matsuzaki et al.
6,144,815 A 11/2000 Chadani et al.
6,173,140 B1 1/2001 Suzuki et al.
6,173,145 B1 1/2001 Chadani et al.
6,205,305 B1 3/2001 Suzuki et al.
6,219,504 B1 4/2001 Matsuzaki et al.
6,282,389 B1 8/2001 Matsuzaki et al.
6,400,914 B1 6/2002 Noda et al.
6,405,004 B2 6/2002 Matsuzaki et al.
6,549,736 B2 4/2003 Miyabe et al.
6,681,088 B2 1/2004 Kanno et al.
6,782,219 B2 8/2004 Yoshino et al.
6,792,229 B2 9/2004 Matsuzaki
6,795,666 B2 9/2004 Miyabe et al.
6,834,173 B2 12/2004 Yamaguchi et al.
6,915,092 B2 7/2005 Yamaguchi et al.
6,931,226 B2 8/2005 Chadani et al.
6,934,485 B2 8/2005 Miyabe et al.
6,947,687 B2 9/2005 Yamaguchi et al.
6,961,528 B2 11/2005 Yamaguchi et al.
6,983,115 B2 1/2006 Isobe et al.
7,068,965 B2 6/2006 Yoshino et al.
7,116,925 B2 10/2006 Yamaguchi
7,136,604 B2 11/2006 Chadani et al.
7,184,687 B2 2/2007 Yamaguchi et al.
7,194,225 B2 3/2007 Yamaguchi
7,224,925 B2 5/2007 Sato et al.
7,319,834 B2 1/2008 Yamaguchi
7,349,657 B2 3/2008 Sato et al.
7,412,193 B2 8/2008 Sato et al.
7,477,865 B2 1/2009 Yamaguchi
7,519,310 B2 4/2009 Yamaguchi et al.
7,792,460 B2 9/2010 Yamaguchi et al.
8,121,519 B2 2/2012 Yamaguchi et al.
8,577,252 B2 11/2013 Anan et al.
8,867,955 B2 10/2014 Yamaguchi et al.
9,063,464 B2 6/2015 Furutani et al.
9,146,500 B2 9/2015 Uesugi et al.
9,152,081 B2 10/2015 Yasui et al.
9,188,906 B2 11/2015 Batori et al.
9,207,581 B2 12/2015 Wada et al.
9,285,707 B2 3/2016 Matsushita et al.
9,291,942 B2 3/2016 Matsuzaki et al.
9,302,801 B2 4/2016 Matsumura et al.
9,304,439 B2 4/2016 Matsuzaki et al.
9,304,441 B2 4/2016 Matsushita et al.
9,341,983 B2 5/2016 Yoshida et al.
9,360,831 B2 6/2016 Matsuzaki et al.
9,383,678 B2 7/2016 Furutani et al.
9,465,356 B2 10/2016 Yamaguchi et al.
9,494,890 B2 11/2016 Komatsu et al.
9,529,304 B2 12/2016 Uesugi et al.
9,599,930 B2 3/2017 Matsuzaki et al.
9,665,040 B2 5/2017 Matsuzaki et al.
9,857,733 B2 1/2018 Matsuzaki
9,885,978 B2 2/2018 Matsuzaki et al.
10,001,727 B2 6/2018 Matsuzaki et al.
2007/0098435 A1 5/2007 Kitagawa et al.
2010/0247135 A1 9/2010 Imaizumi
2017/0351214 A1 12/2017 Uesugi et al.
2018/0004125 A1 1/2018 Nonaka et al.
2018/0113399 A1 4/2018 Matsuzaki et al.
2018/0136588 A1 5/2018 Matsuzaki et al.

FOREIGN PATENT DOCUMENTS

JP 2002-116605 A 4/2002
JP 2013-109209 A 6/2013

(a)

(b)

(a)

(b)

(a)

(b)

(a)

(b)

CARTRIDGE AND IMAGE FORMING APPARATUS HAVING ROLLER SUPPORTED BY ROLLER SUPPORTING PORTIONS

TECHNICAL FIELD

The present invention relates to an image forming apparatus including an electrophotographic photosensitive member and a roller actable on the photosensitive member, and a cartridge detachably mountable to an apparatus main assembly of the image forming apparatus.

Here, the image forming apparatus forms an image on a recording material by using an electrophotographic image formation type. Examples of an electrophotographic image forming apparatus include an electrophotographic copying machine, an electrophotographic printer (such as a laser beam printer, an LED printer or the like), a facsimile machine, and a word processor.

Further, a process cartridge is a cartridge prepared by integrally assembling the photosensitive member and a process means actable on the photosensitive member into a cartridge (unit) detachably mountable to the apparatus main assembly of the image forming apparatus. The apparatus main assembly is a portion of the image forming apparatus from which the process cartridge is removed.

The recording material is a material on which the image is to be formed by the image forming apparatus and includes paper, an OHP sheet, a cloth, etc., for example. Further, the recording material includes an image display member for the image forming apparatus, such as an electronic white board (blackboard).

BACKGROUND ART

Conventionally, in the electrophotographic image forming apparatus, a process cartridge type in which the photosensitive member and the process means actable on the photosensitive member are integrally assembled into a cartridge detachably mountable to the apparatus main assembly of the image forming apparatus has been employed. According to this process cartridge type, maintenance of the image forming apparatus can be carried out by an operator himself (herself) without relying on a service person, so that operativity can be remarkably improved. Therefore, this process cartridge type has been widely used in the image forming apparatus. The process cartridge includes a photosensitive drum (electrophotographic photosensitive drum) which is an image bearing member, a voltage applying device for imparting electric charges to the photosensitive drum, and other process means actable on the photosensitive drum. The process means generally include a developing means for supplying a developer (hereinafter referred to as "toner") to the photosensitive drum, and a cleaning means for removing the toner remaining on a photosensitive drum surface without being transferred.

As a charging means in the voltage applying device, a roller charging means (type) using a charging roller has been widely used in recent years. In the roller charging type, the charging roller which is an electroconductive elastic roller is urged against and contacted to the photosensitive drum, and a voltage is applied to the charging roller, so that a surface of the photosensitive drum is electrically charged. The charging roller is in general in the form in which an entire longitudinal region of a core metal shaft except for both end portions is coated with an elastic layer, and as a supporting constitution, a method of rotatably supporting the core metal shaft end portions by supporting members as disclosed in Japanese Laid-Open Patent Application 2013-109209 is employed in general. Further, the supporting members are supported movably in a radial direction of the photosensitive drum by a frame of the process cartridge, and are urged toward the photosensitive drum by compression coil springs with a predetermined urging force (pressure), so that the charging roller is rotated by rotation of the photosensitive drum.

However, with speed-up and downsizing of the image forming apparatus in recent years, slip is liable to generate between the photosensitive drum and the charging roller. When the slip generates, a charge potential of the photosensitive drum causes a difference between a slip portion and a non-slip portion of the charging roller, so that stripe non-uniformity generates in an electrophotographic image in some cases.

As a countermeasure against the stripe non-uniformity, a sliding torque between the supporting member and the core metal shaft is lowered by reducing a diameter of the core metal shaft of the charging roller, whereby followability to the photosensitive drum can be enhanced. However, with a decreasing core metal shaft diameter, flexural rigidity of the charging roller lowers, with the result that there arises a problem such that the charging roller is not readily uniformly contacted to the photosensitive drum in an entire longitudinal region.

SUMMARY OF THE INVENTION

A principal object of the present invention is to provide a constitution in which followability to a photosensitive drum is improved.

According to an aspect of the present invention, there is provided a cartridge comprising: a photosensitive member; a roller actable on the photosensitive member and including a core metal shaft and a coating layer for coating the core metal shaft; roller supporting portions for rotatably supporting the roller; and a regulating portion for regulating a position of the roller with respect to a longitudinal direction of the roller, wherein the roller supporting portions are provided so as to support one end portion and an other end potion of the core metal shaft, respectively, with respect to a direction of a rotational axis of the roller, wherein the roller is further provided with cylindrical holes disposed at respective ends of the core metal shaft with respect to the direction of the rotational axis and extending in the direction of the rotational axis with the rotational axis as a center, and wherein the roller is supported by the roller supporting portions at inner peripheral surfaces of the holes.

Further features of the present invention will become apparent from the following description of exemplary embodiments with reference to the attached drawings.

DESCRIPTION OF EMBODIMENTS

Embodiments of the present invention will be specifically described with reference to the drawings. Dimensions, materials, shapes and relative arrangements of constituent elements described in the following embodiments should be appropriately be changed depending on structures and various conditions of devices (apparatuses) to which the present invention is applied. Accordingly, the scope of the present invention is not intended to be limited to the following embodiments unless otherwise specified.

Embodiment 1

(Image Forming Apparatus)

Figure 1:
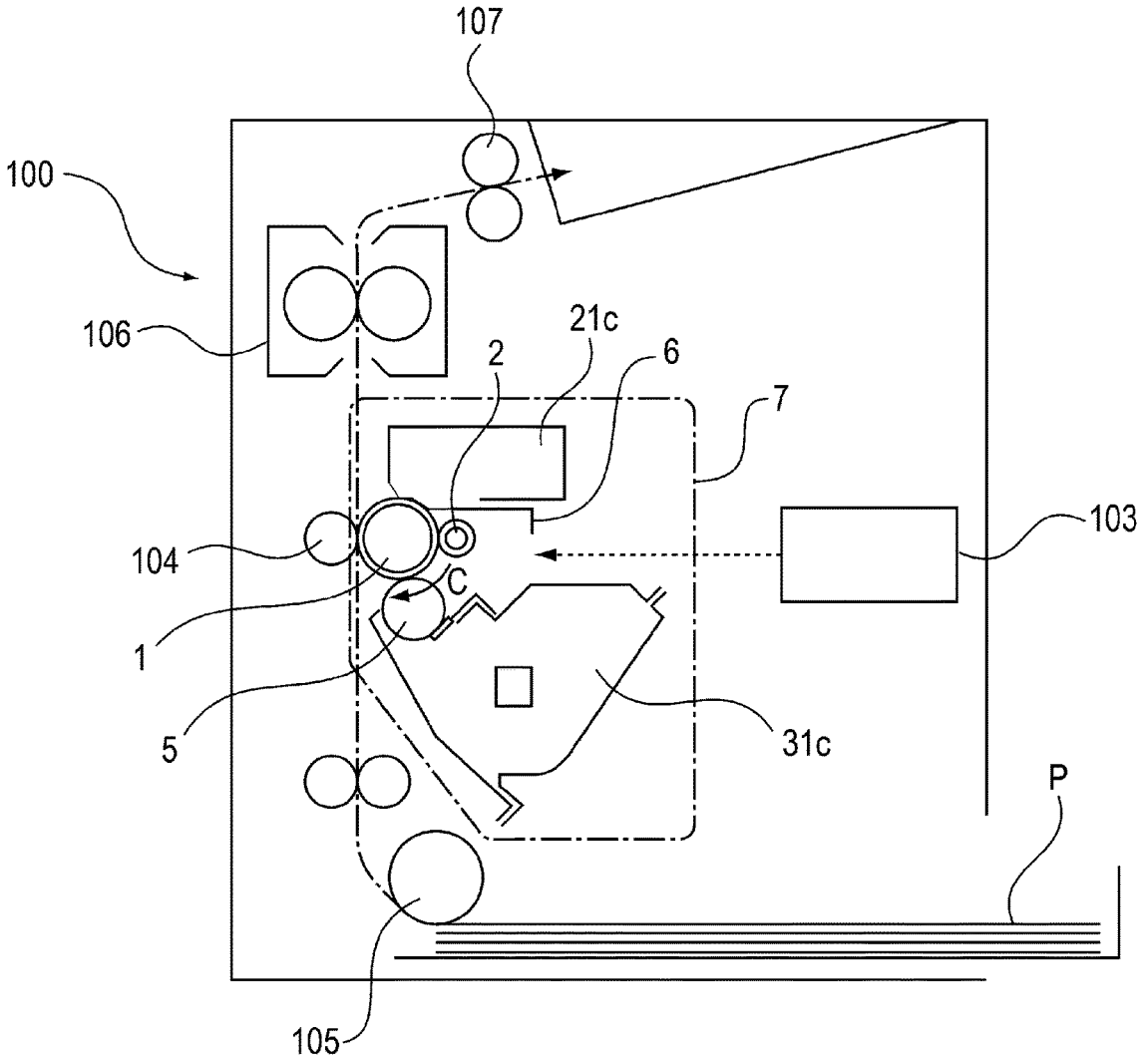
FIG. 1 is a sectional view for illustrating an electrophotographic image forming apparatus according to Embodiment 1.

FIG. 1 is a schematic view showing an image forming apparatus including a voltage applying device in this embodiment. The image forming apparatus includes a photosensitive drum 1 as an image bearing member (member-to-be-charged). At a periphery of the photosensitive drum 1, a charging roller 2, exposure means 103, a developing roller 5, a transfer roller 104 and a cleaning blade 6 are provided. The photosensitive drum 1 as the image bearing member, and as process means actable on the photosensitive drum 1, the charging roller 2, the developing roller 5 and the cleaning blade 6 are integrally assembled as a process cartridge 7, which is detachably mounted in an apparatus main assembly 100 of the image forming apparatus. Further, in the apparatus main assembly 100, a fixing device 106, a feeding roller 105 as a feeding means of a transfer(-receiving) material (recording material such as paper or a sheet) P and an unshown electrical substrate for carrying out electrical control of the image forming apparatus are provided.

The charging roller 2 as a charging means is contacted to the surface of the photosensitive drum 1 with a predetermined urging force and is rotationally driven, and a predetermined charging bias is applied from a charging bias voltage source (not shown) to the charging roller 2, so that the photosensitive drum 1 is electrically charged to a predetermined potential and a predetermined polarity. The developing roller 5 as a developing means carries toner accommodated in a toner accommodating portion 31*c* to a developing position which is a contact position with the photosensitive drum 1. Then, the toner is deposited on an electrostatic latent image formed on the photosensitive drum 1, so that the electrostatic latent image is developed (visualized) as a toner image. To the developing roller 5, a predetermined developing bias is applied from a developing bias voltage source (not shown). The transfer roller 104 as a transfer means is contacted to the surface of the photosensitive drum 1 with a predetermined urging force and is rotationally driven, and a predetermined transfer bias is applied from a transfer bias voltage source (not shown) to the transfer roller 104. Then, the toner image is transferred from the surface of the photosensitive drum 1 onto the transfer (-receiving) material P as a transfer-receiving member to be fed to a transfer nip between the transfer roller 104 and the photosensitive drum 1. The transfer material P on which the toner image is transferred is fed to the fixing device 106, where predetermined pressure and heat are applied to the toner image, so that the toner image is fixed on the transfer material P. Thereafter, the transfer material P is discharged from the apparatus main assembly 100 to an outside by a discharging roller pair 107. The cleaning blade 6 as a cleaning means removes transfer residual toner remaining on the surface of the photosensitive drum 1 after the transfer and collects the transfer residual toner in a residual toner accommodating portion 21*c*. Thereafter, the above-described process is repeated in a similar manner.

(Process Cartridge)

Figure 2:
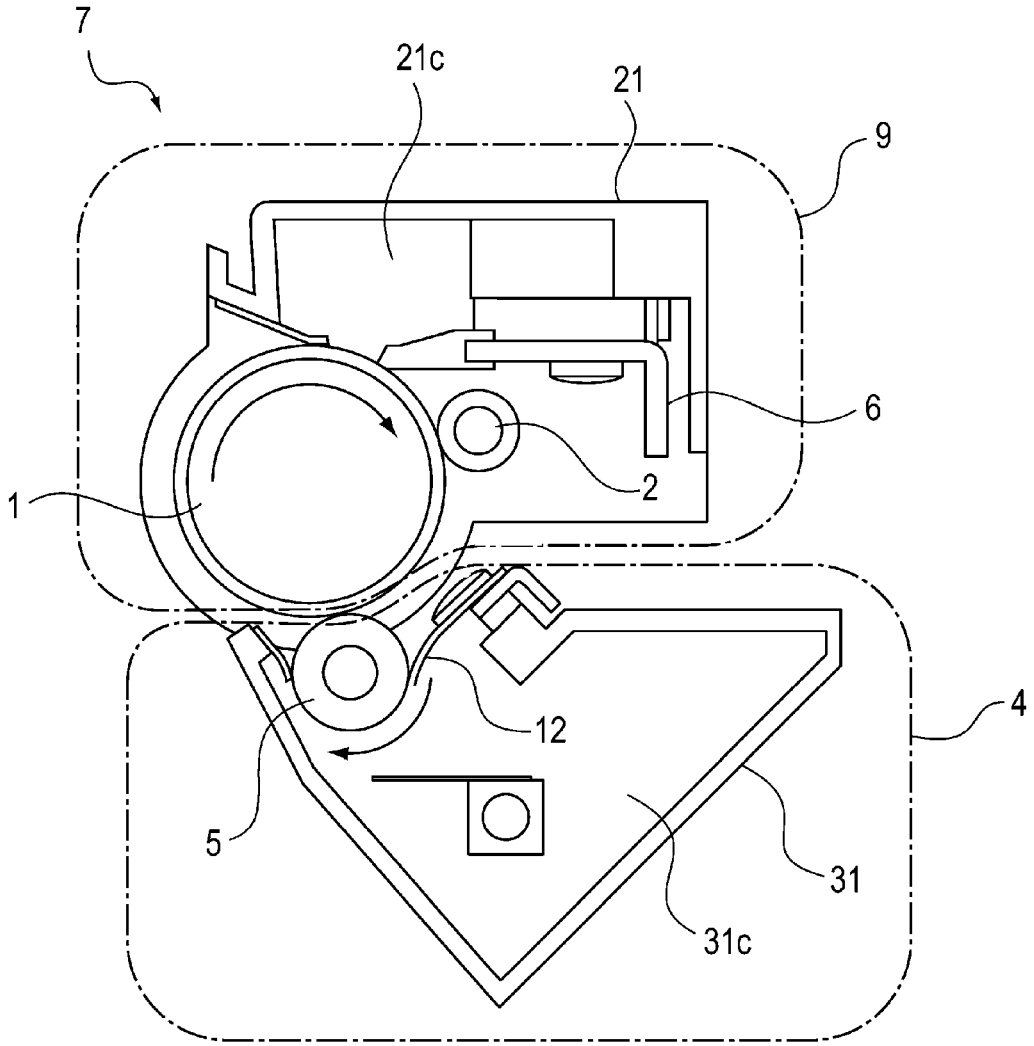
FIG. 2 is a cross-sectional view of a process cartridge in Embodiment 1.

A structure of the process cartridge 7 will be described based on FIG. 2. FIG. 2 is a sectional view of the process cartridge 7.

The process cartridge 7 is roughly consisting of a cleaning unit 9 and a developing unit 4. The cleaning unit 9 is prepared by integrally holding the photosensitive drum 1, the cleaning blade 6 and the charging roller 2 by a cleaning (unit) frame 21 in the form of a unit. In the cleaning frame 21, the residual toner accommodating portion 21*c* is formed. On the other hand, the developing unit 4 is prepared by integrally holding the developing roller 5 and a developing blade 12 by a developing (unit) frame 31 in the form of a unit. Further, in the developing frame 31, the toner accommodating portion 31*c* is formed. The developing unit 4 is swingably supported relative to the cleaning unit 9 by unshown supporting portions provided at longitudinal end portions thereof. The developing unit 4 is urged rotationally about an unshown supporting portion in a direction in which the developing roller 5 contacts the photosensitive drum 1 by an unshown pressing spring.

The process cartridge 7 is provided at one longitudinal end thereof with a drive inputting portion engaging with an unshown drive imparting portion provided in the apparatus main assembly 100, so that a rotational driving force is transmitted to the photosensitive drum 1 and the developing roller 5.

(Cleaning Unit)

Figure 3:
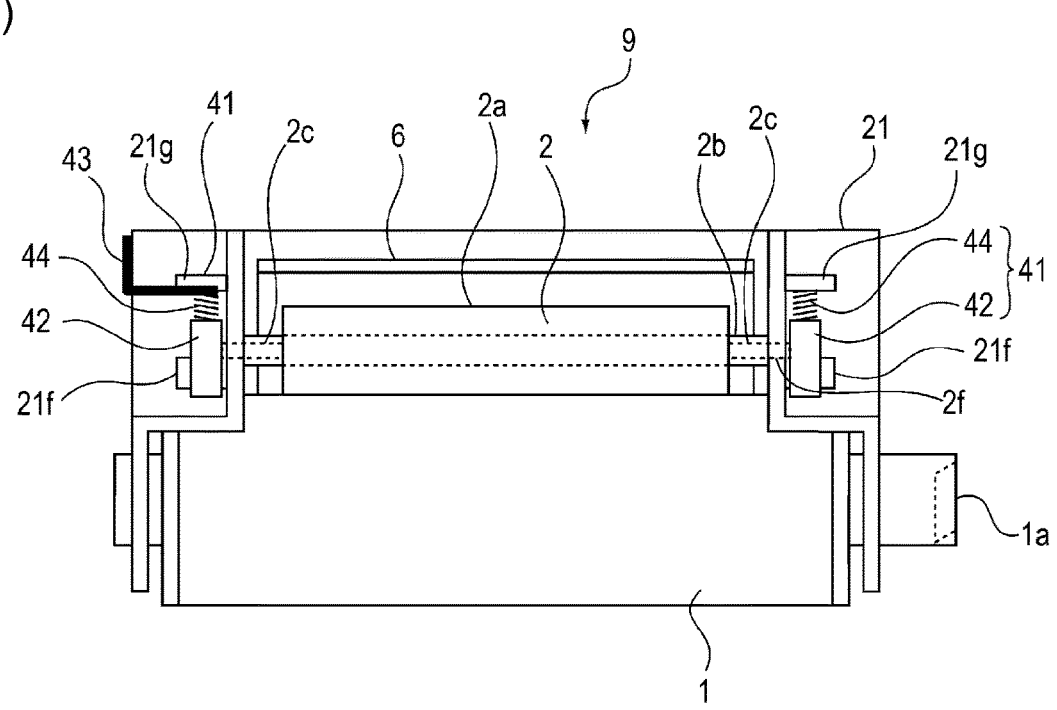
In FIG. 3, (a) is a front view of a cleaning unit in Embodiment 1, and (b) is a sectional view of a charging roller supporting portion in Embodiment 1.
Figure 3:
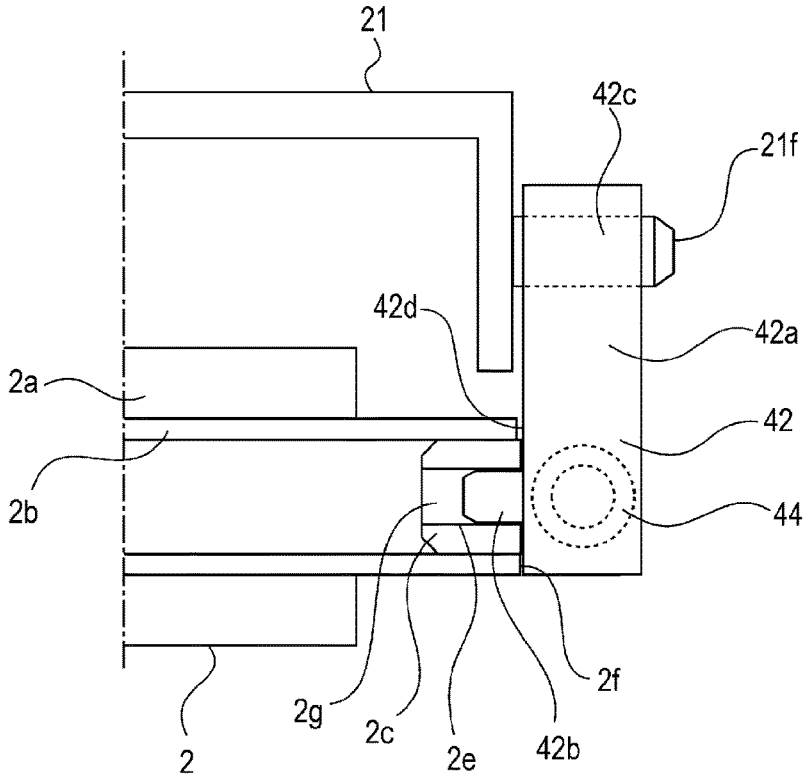
Figure 4:
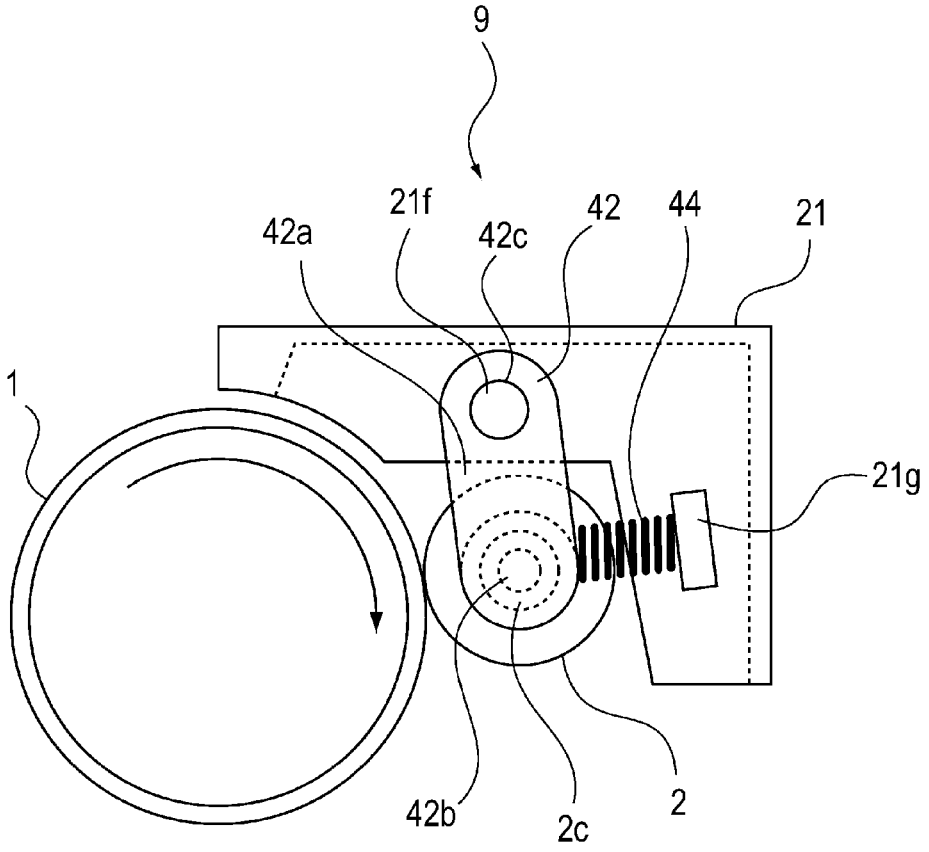
FIG. 4 is a side view of the cleaning unit in Embodiment 1.

A structure of the cleaning unit 9 will be described with reference to FIGS. 3 and 4. In FIG. 3, (a) is a front view of the cleaning unit 9, (b) is a sectional view of a supporting portion for supporting the charging roller 2. FIG. 4 is a side view of the cleaning unit 9.

The cleaning frame 21 rotatably supports longitudinal end portions of the photosensitive drum 1 as shown in (a) of FIG. 3. At one longitudinal end of the photosensitive drum 1, a drive inputting portion 1*a* is provided and is engaged with an unshown drive imparting portion provided in the apparatus main assembly 100, so that the driving force is transmitted to the photosensitive drum 1 and the developing roller 5. The drive inputting portion 1*a* is a driving force receiving portion for receiving the driving force from the apparatus main assembly 100. At a side surface in a side opposite from the side where the drive inputting portion 1*a* is provided, an energization member 43 contacting an unshown energizing portion of the apparatus main assembly 100 of the image forming apparatus is provided.

The charging roller 2 includes a hollow core metal shaft 2*b*, an electroconductive elastic layer 2*a* as a coating layer for coating an entire longitudinal region of the core metal shaft 2*b* except for longitudinal end portions, and end portion members (hereinafter referred to as caps) 2*c*, formed of a resin material, mounted at the longitudinal end portions of the core metal shaft 2*b*. The core metal shaft 2*b* is prepared by molding a stainless steel plate in a cylindrical shape by press work. Of the two caps 2*c* and 2*c* at the end portions of the core metal shaft 2*b*, the cap 2*c* in the side where the energization member 43 is provided (the left-hand side in (a) of FIG. 3) is formed of an electroconductive resin material.

(Supporting Constitution of Charging Roller)

A supporting constitution of the charging roller 2 will be described with reference to (b) of FIG. 3. Incidentally, the charging roller supporting constitution is, as shown in (a) of FIG. 3, constituted bilaterally symmetrically with respect to an axial direction center (line) as a center in both sides with respect to an axial direction (longitudinal direction) of the charging roller 2. For that reason, members and portions having the same functions are represented by the same reference numerals or symbols. Further, in (b) of FIG. 3, as a charging roller supporting constitution, that in a drive inputting side (side where the drive inputting portion 1*a* is provided is shown as an example, and also that in an unshown energization side (side where the energization member 43 is provided) is similarly constituted. Incidentally, the axial direction (rotational axis direction) of the charging roller 2 and the longitudinal direction are parallel to each other.

The cap 2*c* has a hollow cylindrical shape as shown in (b) of FIG. 3, and an outer peripheral portion thereof is engaged with and fixed to an inner peripheral portion of the core metal shaft 2*b*. On the other hand, at each of side surfaces of the cleaning frame 21, a roller supporting member 42 for supporting the charging roller 2 is swingably supported. Of the two roller supporting members 42 supporting the charging roller 2 at both end portions, the roller supporting member 42 (in the left side of (a) of FIG. 3) in the side where the energization member 43 is provided is formed of an electroconductive resin material. Each of the two roller supporting members 42 is constituted by a hole 42*c* as a swing center, a roller supporting portion 42*b* and an arm portion 42*a* connecting between the hole 42*c* as the swing center and the roller supporting portion 42*b*. With a boss 21*f* provided on the side surface of the cleaning frame 21, the hole 42*c* of the roller supporting member 42 is rotatably engaged. The roller supporting portion 42*b* has a boss shape projecting toward a longitudinal central portion of the charging roller 2. Further, the two roller supporting members 42 are urged by pressing springs 44 in a direction toward the photosensitive drum 1 in the neighborhood of the roller supporting portions 42*b*. Each of the pressing springs 44 is formed with a compression coil spring. On the side surface of the cleaning frame 21, a bearing surface 21*g* of the pressing spring 44 is provided, and supports the pressing spring 44. The cap 2*c* is provided with a hole 2*g*, and the roller supporting portion 42*b* engages with a portion-to-be-supported 2*e* which is an inner peripheral surface of the hole 2*g* of the cap 2*c*. The hole 2*g* is disposed at each of the both end portions of the charging roller 2 with respect to a rotational axis direction of the charging roller 2 and is a cylindrical hole extending in a direction of a rotational axis about the rotational axis of the charging roller 2 as a center. An inner surface of the portion-to-be-supported 2*e* is set so as to be slightly larger than an outer diameter of the roller supporting portion 42*b*. As shown in (a) of FIG. 3, the two roller supporting members 42 are provided so as not to penetrate through the core metal shaft 2*b* with respect to the rotational axis direction of the charging roller 2. That is, with respect to the rotational axis direction of the charging roller 2, the roller supporting members 42 are provided separately so as to support the core metal shaft 2*b* at one end portion and the other end portion, respectively. That is, the roller supporting portions 42*b* are provided as separate portions for one end portion and the other end portion of the core metal shaft 2*b*, respectively, and are not directly connected with each other.

As described above, an urging means 41 for urging the charging roller 2 in a direction toward the photosensitive drum 1 is constituted by the pressing spring 44 which is an elastic portion and the roller supporting member 42 (the swingable arm portion 42*a* and the roller supporting portion 42*b*). By thus constituting the urging means 41, the charging roller 2 is urged at the portion-to-be-supported 2*e* thereof toward an axial center of the photosensitive drum 1 by the pressing spring 44, and is rotatably supported.

An urging force of the pressing spring 44 is set so that the pressing spring 44 generates an urging force of 500 gf in a state in which the charging roller 2 contacts the photosensitive drum 1. In this embodiment, the compression coil spring is illustrated as an example of the elastic portion, but the elastic portion is not limited to the compression coil spring. The elastic portion may have any constitution when the elastic portion can generate a desired urging force.

Further, the urging means 41, the boss 21*f* said and the bearing surface 21*g* in the drive inputting portion 1*a* side are disposed at positions where these portions are rotated relative to the urging means 41, the boss 21*f* and the bearing surface 21*g* in the opposite side (the energization member 43 side) by a predetermined angle (1.2° in this embodiment) toward an upstream side with respect to a rotational direction of the photosensitive drum 1 with the axial center of the photosensitive drum 1 as a rotation center. That is, a rotation shape (axis) of the charging roller 2 is inclined relative to a rotation shape (axis) of the photosensitive drum 1 so as to be positioned so that a shape end in the drive inputting portion 1*a* side is positioned in a side upstream of a shape end in the energization member 43 side with respect to the rotational direction of the photosensitive drum 1. As a result, when the photosensitive drum 1 starts rotation thereof, the charging roller 2 is obliquely moved toward the drive inputting portion 1*a* side (the right side of (a) of FIG. 3), so that a side end surface 2*f* of the charging roller 2 contacts an inside surface 42*d* of the roller supporting member 42 and is positioned with respect to the longitudinal direction. That is, the inside surface 42*d* of the roller supporting member 42 and the side end surface 2*f* of the charging roller 2 act as a limiting surface (limiting portion) and a portion-to-be-limited, respectively.

Further, one end of the energization member 43 is provided between the pressing spring 44 and the bearing surface 21*g* in the energization member 43 side (the left side of (a) of FIG. 3). The pressing spring 44 is formed of an iron-based steel material, and has electroconductivity. Further, the core metal shaft 2*b* is formed with the stainless steel plate as described above, and similarly has electroconductivity. That is, by employing the above-described constitution, from an unshown energizing portion of the apparatus main assembly 100 of the image forming apparatus, a desired voltage is applied to the charging roller 2 via the energization member 43, the pressing spring 44, the roller supporting member 42 and the cap 2*c*.

(Rotational Operation of Charging Roller)

Figure 5:
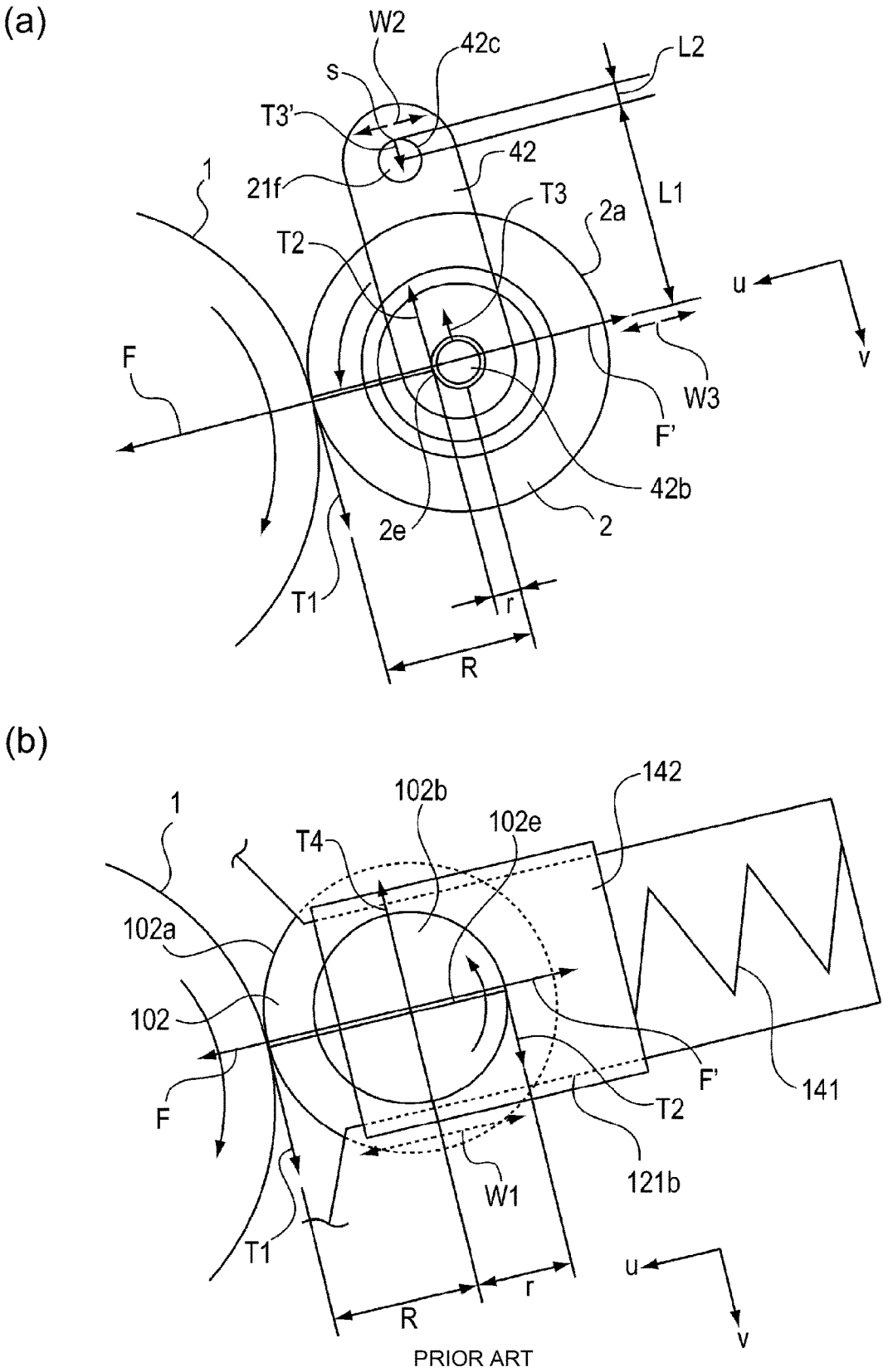
In FIG. 5, (a) is a schematic view showing forces acting on a charging roller in Embodiments 1-3, and (b) is a schematic view showing forces acting on a charging roller in a conventional constitution.

A rotational operation of the charging roller 2 will be described with reference to FIG. 5 by performing a comparison between the constitution in this embodiment and the constitution (conventional constitution) in a comparison example. In FIG. 5, (a) is a schematic view showing forces exerted on the charging roller 2 in this embodiment, and (b) is a schematic view showing forces exerted on the charging roller 102 in the comparison example. In FIG. 5, solid line arrows represent forces exerted on the charging roller 2, and dotted line arrows represent forces exerted on parts other than the charging roller 2. Incidentally, on the charging roller 2, gravitation acts, but the gravitation equally acts on the charging rollers in this embodiment in the comparison example, and a functional effect is obtained irrespective of the direction of gravitation and therefor the gravitation is omitted from illustration.

In the comparison example, as shown in (b) of FIG. 5, a charging roller 102 is supported at an outer peripheral surface by a roller supporting member 142 formed of a resin material at each of both end portions of a solid core metal shaft 102*b*. Further, the roller supporting member 142 is supported movably in a radial direction of the photosensitive drum 1 by a supporting portion 121*b* of a cleaning frame, and is urged in a direction toward the photosensitive drum 1 by a pressing spring 141. In the following description, the direction in which the charging roller 2 (102) moves toward the photosensitive drum 1 is represented by an arrow u, and the direction which is perpendicular to the arrow u and in which the charging roller 2 (102) moves toward a downstream side with respect to the rotational direction of the photosensitive drum 1 is represented by an arrow v.

The charging roller 2 (102) is required to be rotated by the photosensitive drum 1 without slipping with the photosensitive drum 1. Force acting on the charging roller 2 (102) in the arrow u direction include an urging force F for urging the charging roller 2 (102) in the direction toward the photosensitive drum 1 by the pressing spring 44 (141) and drag F' for supporting the charging roller 2 (102) by the photosensitive drum 1 against the urging force F. These forces are balanced with each other, and therefore the following formula 1 is satisfied.

$$F=F' \quad \text{(formula 1)}$$

Further, as regards forces acting in the arrow v direction, a frictional force T1 in which the photosensitive drum 1 is pulled in the rotational direction of the photosensitive drum 1 at a surface of the elastic layer 2*a* (102*a*) of the charging roller 2 (102) and a frictional force T2 for preventing rotation of the charging roller 2 (102) at the portion-to-be-supported 2*e* (102*e*) exist with associated constitutions. In the case of the comparison example, the portion-to-be-supported 102*e* is an outer peripheral portion of the core metal shaft 102*b*, and the portion-to-be-supported 2*e* in this embodiment is the inner peripheral surface of the cap 2*c*. The frictional forces T1 and T2 are proportional to normal reaction, and therefore are represented by the following formulas 2 and 3, respectively.

$$T1=\mu1\times F \quad \text{(formula 2)}$$

$$T2=\mu2\times F \quad \text{(formula 3)}$$

Here, μ1 is a frictional coefficient between the surface of the photosensitive drum 1 and the surface of the elastic layer 2*a* (102*a*) of the charging roller 2 (102). Further, μ2 is a frictional coefficient between the roller supporting member 142 and the outer peripheral surface of the core metal shaft 102*b* which is a portion-to-be-supported in the comparison example, and is a frictional coefficient between the roller supporting portion 42*b* and the portion-to-be-supported 2*e* in this embodiment. However, the frictional coefficients in the constitutions of this embodiment and the comparison example can be made equal to each other by appropriately selecting the materials used, and therefore in this case, it is assumed that the frictional coefficients in the respective constitutions are equal to each other. In order to cause the charging roller 2 (102) to follow the photosensitive drum 1, with respect to a balance of moment of the charging roller 2 (102) about the axial center of the charging roller 2 (102), there is a need that moment in a direction (the counterclockwise direction in FIG. 5) in which the charging roller 2 follows the photosensitive drum 1 is larger than frictional load moment (in the clockwise direction) of the portion-to-be-supported. That is, the following formula 4 is satisfied.

$$R\times T1>r\times T2 \quad \text{(formula 4)}$$

Here, R is a radius of the elastic layer 2*a* (102*a*) of the charging roller 2 (102), and r is radius of the portion-to-be-supported 2*e* (102*e*). When the formulas 1 to 3 are substituted into the formula 4, the following formula 5 is obtained.

$$\mu1\times R>\mu2\times r \quad \text{(formula 5)}$$

From the formula 5, it is understood that in order to improve rotation followability to the photosensitive drum 1, an increase in the radius R of the elastic layer 2*a* (102*a*) of the charging roller 2 (102) or a decrease in the radius r of the portion-to-be-supported is effective. The increase in the radius R of the elastic layer 2*a* of the charging roller 2, i.e., an increase in outermost diameter leads to upsizing of the process cartridge and an increase in cost of the charging roller 2, and therefore is not desirable. In order to improve followability, it is desirable that the radius r of the portion-to-be-supported is made small. In order to ensure flexural rigidity of the charging roller 2, there is a need that the outer diameter of the core metal shaft 2*b* ensures a thickness to some extent, but by employing the constitution of this embodiment, the radius r of the portion-to-be-supported 2*e* can be set at a small value. For that reason, rotation followability to the photosensitive drum 1 can be improved compared with the comparison example.

(Translational Operation of Charging Roller)

By employing the constitution of this embodiment, translational followability to the photosensitive drum 1 in the arrow u direction can also be improved. This will be described below. In the comparison example, as shown in (b) of FIG. 5, on the charging roller 102, the frictional forces T1 and T2 act in the arrow v direction, and a force T4 for supporting the core metal shaft 102*b* by the roller supporting member 142 acts in the direction opposite to the arrow v direction, and the frictional forces T1, T2 and the force T4 are balanced with each other. That is, the following formula 6 is satisfied.

$$T4=T1+T2 \quad \text{(formula 6)}$$

Accordingly, the supporting portion 121*b* of the cleaning frame supports the roller supporting member 142 with the force T4. Then, on the roller supporting member 142, a frictional force W1 proportional to the force T4 generates in the arrow u direction or a direction opposite to the arrow u direction. When a frictional coefficient is represented by μ3, the frictional force W1 is represented by the following formula 7 (into which the formula 6 is substituted).

$$W1=\pm\mu3\times T4=\pm\mu3(T1+T2) \quad \text{(formula 7)}$$

On the other hand, in this embodiment, as shown in (a) of FIG. 5, on the charging roller 2, the frictional force T1 acts in the arrow v direction, and the frictional force T2 and a force T3 for supporting the charging roller 2 by the roller supporting member 42 act in the direction opposite to the arrow v direction, and the frictional forces T1, T2 and the force T3 are balanced with each other. That is, the following formula 8 is satisfied.

$$T3=T1-T2 \quad \text{(formula 8)}$$

On the boss 21*f*, a force T3' equal in magnitude to the force T3 acts in the opposite direction to the direction of the force T3. When a frictional coefficient between the boss 21*f* and the hole 42*c* is represented by μ4 and when the charging roller 2 swings in the arrow u direction, at a supporting portion s of the roller supporting member 42 by the boss 21*f*, a frictional force W2 generates in the arrow u direction. That is, the frictional force W2 is represented by the following formula 9 (into which the formula 8 is substituted).

$$W2 = \pm\mu4\times T3' \quad \text{(formula 9)}$$
$$= \pm\mu4\ (T1 - T2)$$

A frictional force W3 exerting in the arrow u direction against the urging force F at the charging roller 2 is represented, on the basis of a lever ratio of the roller supporting member 42, by the following formula 10 (into which the formula 9 is substituted) when a distance from the center of the hole 42*c* to the center of the roller supporting portion 42*b* is L1 and a distance from the center of the hole 42*c* to the supporting portion s is L2.

$$W3 = (\pm L2/L1)\times W2 \quad \text{(formula 10)}$$
$$= (\pm L2/L1)\times\mu4\ (T1 - T2)$$

Compared with the distance L2, the distance L1 is sufficiently large, and therefore by the leverage effect, the frictional force W3 is remarkably smaller than the frictional force W2. The frictional forces of the charging roller 2 in the arrow u direction are compared with each other. The frictional coefficients μ3 and μ4 can be made equal to each other by appropriately selecting the materials, and therefore in this case, it is assumed that μ3=μ4 holds. Then, it is clear from a comparison between the formulas 7 and 10 that the frictional force W3 in this embodiment is remarkably smaller than the frictional force W1 in the comparison example. In other words, in the comparison example, the frictional force W1 is proportional to the sum of the frictional forces T1 and T2, whereas in this embodiment, the frictional force W3 is proportional to the difference between the frictional forces T1 and T2 and is also remarkably suppressed by the leverage effect. The low frictional force in the arrow u direction means nothing other than improvement in translational followability to the photosensitive drum 1 in the arrow u direction. With speed-up of the image forming apparatus in recent years, it is desired that the charging roller 2 translates and follows a minute change in radius of the photosensitive drum 1 with reliability, but by employing the constitution of this embodiment, it is more easy to meet the speed-up.

In order to always uniformly charge the photosensitive drum 1 by the charging roller 2 with no non-uniformity, there is a need that not only the charging roller 2 is always rotated by the photosensitive drum 1 without slipping with the photosensitive drum 1, i.e., the charging roller 2 is excellent in rotational followability, but also the nip between the charging roller 2 and the photosensitive drum 1 is kept at a constant value without separation of the charging roller 2 from the photosensitive drum 1, i.e., the charging roller 2 is excellent in translational followability. When at least one of the rotational followability and the translational followability is impaired, the charging roller 2 cannot always uniformly charge the photosensitive drum 1, and therefore, there is a great significance in that both of the rotational followability and the translational followability are kept simultaneously at a certain level or more.

As described above, according to this embodiment, it is possible to simultaneously improve the rotational followability and the translational followability of the charging roller 2 to the photosensitive drum 1 while maintaining desired flexural rigidity of the charging roller 2. As a result, a high-quality electrophotographic image can be stably provided. Further, at the same time, a sliding speed between the cap 2*c* and the roller supporting portion 42*b* in the energization member 43 side lowers, so that a change in electric resistance at the sliding portion can be suppressed. Also this effect contributes to stable provision of the high-quality electrophotographic image.

(Position of Portion-to-be-Supported of Charging Roller)

A position of the portion-to-be-supported 2*e* with respect to the rotational axis direction of the charging roller 2 will be described. As shown in (b) of FIG. 3, the portion-to-be-supported 2*e* is provided at each of the both end portions (in (b) of FIG. 3, one end portion with respect to the rotational axis direction is illustrated) of the charging roller 2, and is rotationally supported by the roller supporting portion 42*b* of the roller supporting member 42. The portion-to-be-supported 2*e* is provided inside the core metal shaft 2*b* of the charging roller 2 and is disposed at a between overlapping with the elastic layer 2*a* with respect to the rotational axis direction of the charging roller 2.

An effect of a constitution in which the portion-to-be-supported 2*e* is disposed at the position overlapping with the elastic layer 2*a* with respect to the rotational axis direction of the charging roller 2 will be described with reference to FIG. 12.

Incidentally, the roller supporting member 42 contacts the portion-to-be-supported 2*e* and urges the charging roller 2 against the photosensitive drum 1 at the portion-to-be-supported 2*e*. In the following, a position where the roller supporting portion 42*b* of the roller supporting member 42 urges the portion-to-be-supported 2*e* is an urging position.

Figure 12:
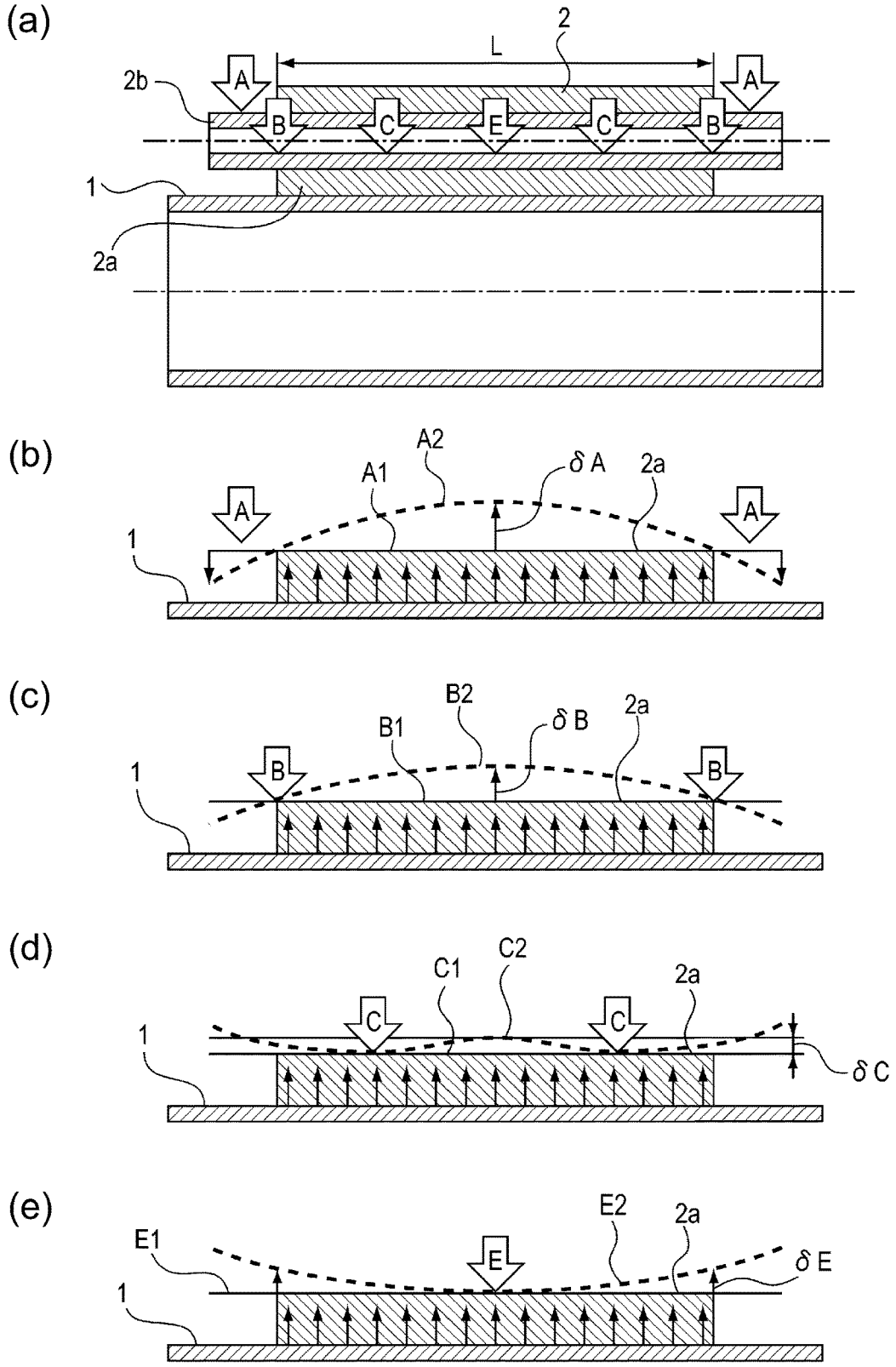
In FIG. 12, (a) to (e) are schematic views of forces acting on the charging roller.

In FIG. 12, (a) is a schematic view showing a state in which the charging roller 2 is urged against the photosensitive drum 1. In FIG. 12, arrows A, B, C, E represent urging positions with respect to the rotational axis direction of the charging roller 2. Here, with respect to the rotational axis direction of the charging roller 2, the arrow A shows an outside of an end portion position of the elastic layer 2*a*, the arrow B shows the end portion position (extreme end) of the elastic layer 2*a*, the arrow C shows an inside of the end portion position of the elastic layer 2*a*, and the arrow E shows a center position of the elastic layer 2*a*. Here, a deformation image of the core metal shaft 2*b* before urging is shown by a solid line A1, B1, C1 or E1, and the deformation image of the core metal shaft 2*b* after the urging is shown by a broken line A2, B2, C2 or E2. Further, maximum distortion (deformation) of the core metal shaft 2*b* when the urging is made as shown by the arrow A, B, C or E is represented by δA, δB, δC or δE, respectively.

Further, in FIG. 12, the arrow A is an urging position in the comparison example (conventional constitution), and each of the arrows B, C and E is an example of the urging position in the case where the urging is made at the inner peripheral surface of the elastic layer in this embodiment.

As shown in (b) of FIG. 12, a degree of distortion at the center of the core metal shaft 2*b* becomes larger as the urging position with respect to the rotational axis direction of the charging roller 2 is more spaced from the end portion position (extreme end) of the elastic layer 2*a* shown in (c) of FIG. 12 toward the outside. In the case where the charging roller 2 is supported at a position outside the extreme end of the elastic layer 2*a*, all of the forces acting on the core metal shaft 2*b*, i.e., not only the urging force in the compressed state but also a repelling force from the elastic layer 2*a* in the inside thereof act as bending moment for deforming the core metal shaft 2*b* convexly upward as shown in (b) of FIG. 12. For that reason, the bending moment becomes larger as the urging position is more spaced from the extreme end of the elastic layer 2*a* toward the outside. Therefore, as shown in (a), (b) and (c) of FIG. 12, the maximum distortion δA of the core metal shaft 2*b* in the case where the charging roller 2 is urged at the position of the arrow A which is the outside of the elastic layer 2*a* is larger than the maximum distortion δB of the core metal shaft 2*b* in the case where the charging roller 2 is urged at the position of the arrow B which is the extreme end of the elastic layer 2*a* (δA>δB).

In the case of the constitution in which the outer peripheral surface of the core metal shaft 2*b* is supported, in order to minimize the distortion at the center of the elastic layer 2*a* with respect to the rotational axis direction, it is only required that a constitution in which the charging roller 2 is urged at a just extreme end position of the elastic layer 2*a* is employed. However, the core metal shaft 2*b* has to be rotatably supported, and therefore, a bearing member for rotatably supporting the core metal shaft 2*b* is needed, so that a width, with respect to the axial direction, for permitting the sectional view of the core metal shaft 2*b* by the bearing member is required to some extent. Accordingly, even when the urging position of the core metal shaft 2*b* is the center of the width of the bearing member with respect to the rotational axis direction, the bearing member has to urge the outside of the extreme end (end portion position) of the elastic layer 2*a* by half of the width. However, in this embodiment, the constitution in which the inner peripheral surface of the core metal shaft 2*b* is supported is employed, and therefore there is no such constraint, so that it is possible to urge the extreme end (end portion position) shown by the arrow B in (c) of FIG. 12) of the elastic layer 2*a*. As a result, compared with the case of the comparison example (conventional constitution) in which the outer peripheral surface of the core metal shaft 2*b* is supported, in this embodiment, the bending moment acting on the core metal shaft 2*b* can be suppressed to a smaller value. For that reason, compared with the comparison example, the degree of the distortion at the center of the core metal shaft 2*b* with respect to the rotational axis direction can be made small (δA>δB).

With reference to (d) of FIG. 12, the case where the charging roller 2 is urged at the position of the arrow C which is a further inside of the extreme end (arrow B position) of the elastic layer 2*a* with respect to the rotational axis direction of the charging roller 2 will be described. As shown in (d) of FIG. 12, in the case of the constitution in which the charging roller 2 is urged at the arrow C position, with respect to the rotational axis direction, the core metal shaft 2*b* is flexed toward the photosensitive drum at the urging position (arrow C position) and is flexed in a direction, in which the charging roller 2 is spaced from the photosensitive drum 1, at the center (position of the arrow E) and at the extreme end (position of the arrow C).

At this time, at a central portion between the two arrows C with respect to the rotational axis direction, the charging roller 2 is flexed in the direction in which the charging roller 2 is spaced from the photosensitive drum 1, and at the same time, is flexed toward the photosensitive drum 1 in the outsides of the arrows C. Further, with respect to the rotational axis direction, in the outsides of the arrows C, the charging roller 2 is flexed in the direction in which the charging roller 2 is spaced from the photosensitive drum 1, and at the same time, in the inside of the arrows C, the charging roller 2 is flexed toward the photosensitive drum 1. By interaction of these, with respect to the rotational axis direction, in both sides (central side and outside) sandwiching the urging position (position of the arrow C), the flexure in the direction in which the charging roller 2 is spaced from the photosensitive drum 1 is cancelled.

As shown in (b) of FIG. 12, when the urging position is in the outside of the extreme end of the elastic layer 2*a* with respect to the rotational axis direction, this "action for reducing the flexure by cancellation" does not generate, so that as described above, all of the forces act as the moment for flexing the elastic layer 2*a* in one direction.

Therefore, the maximum distortion can be more suppressed in the case where the elastic layer 2*a* is urged at the positions of the arrows C ((d) of FIG. 12) than in the case where the elastic layer 2*a* is urged at the positions of the arrows B ((c) of FIG. 12) (δC<δB), so that a difference in pressure exerted on the core metal shaft 2*b* can be made smaller with respect to the rotational axis direction.

In the case where the urging position is caused to approach the center as shown in (a) and (e) of FIG. 12 and is in the neighborhood of the center with respect to the rotational axis direction, a degree of distortion (flexure) increases at the extreme ends of the elastic layer 2*a*. Distortion δE in the case where the elastic layer 2*a* is urged as shown by the arrow E is smaller than the distortion δB in the case where the elastic layer 2*a* is urged as shown by the arrow B (δE<δB).

As described above, if the portion-to-be-supported 2*e* is positioned inside the elastic layer 2*a* of the core metal shaft 2*b*, even when the elastic layer 2*a* is urged at any position, the degree of the distortion of the core metal shaft 2*b* can be made smaller compared with the constitution (comparison example) in which the charging roller 2 is urged outside the elastic layer 2*a* while being supported at the outer peripheral surface of the core metal shaft 2*b*.

When a full length of the elastic layer 2*a* with respect to the axial direction is L, the maximum distortion of the core metal shaft 2*b* can be minimized in the case where the charging roller 2 is urged inside each of the extreme end positions in both sides of the elastic layer 2*a* by about 0.2 L. Thus, it is preferable that the charging roller 2 is urged at the position inside each of the extreme end positions in both sides of the elastic layer 2*a* by about 0.2 L.

As described above, as in this embodiment, by disposing the portion-to-be-supported 2*e* at the position overlapping with the elastic layer 2*a* with respect to the rotational axis direction of the charging roller 2, it is possible to decrease the difference in pressure between the end portion and the central portion with respect to the rotational axis direction of the charging roller 2. For this reason, a phenomenon that the central portion of the charging roller 2 with respect to the rotational axis direction does not readily contact the opposing photosensitive drum 1 does not readily generate. That is, according to this embodiment, with an inexpensive constitution, the difference in pressure between the end portion and the central portion with respect to the rotational axis direction of the charging roller 2, and therefore, it is possible to improve contact uniformity of the charging roller with the photosensitive drum while maintaining the flexural rigidity of the roller with the inexpensive constitution.

Embodiment 2

Figure 6:
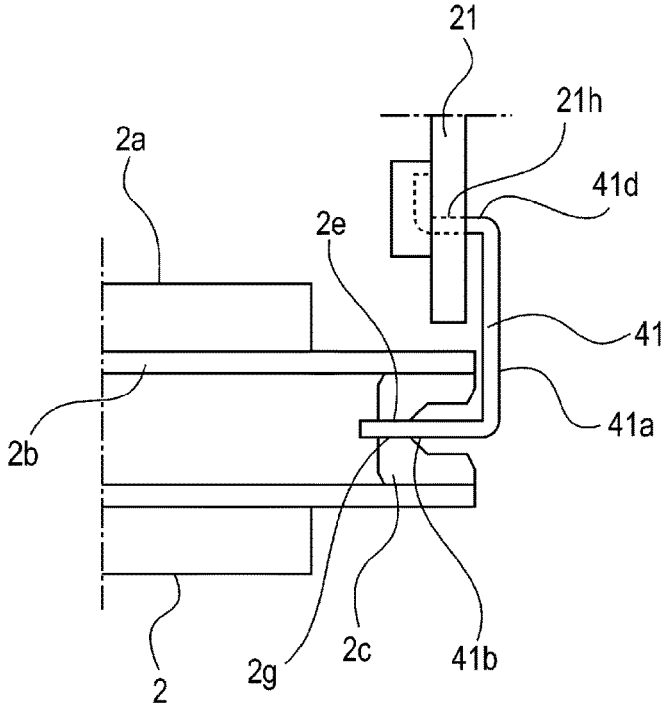
In FIG. 6, (a) is a sectional view of a charging roller supporting portion in Embodiment 2, and (b) is a side view of a cleaning unit in Embodiment 2.
Figure 6:
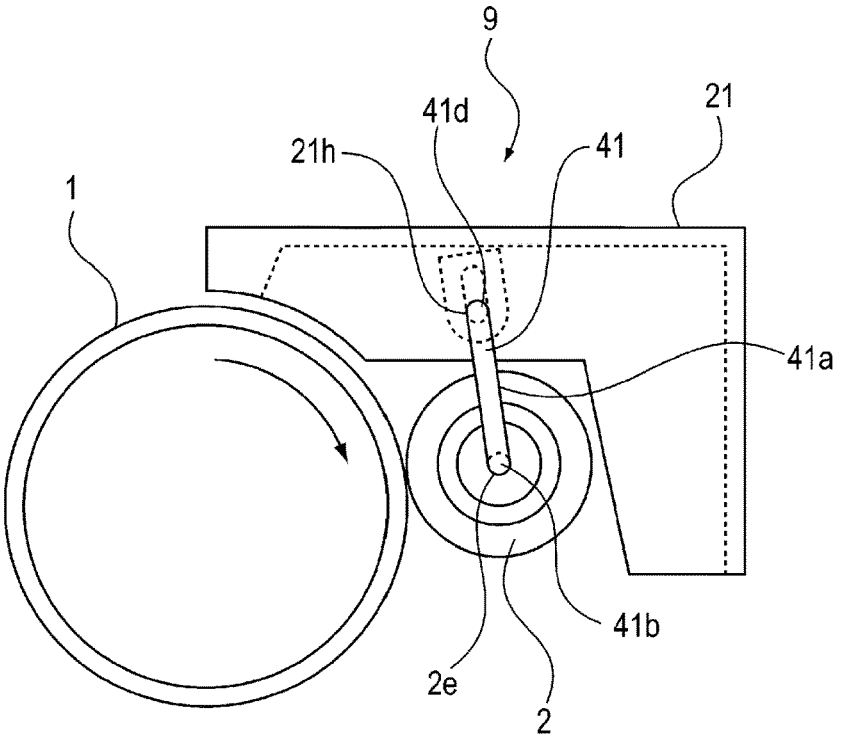

A constitution according to Embodiment 2 will be described based on FIG. 6. In FIG. 6, (a) is a sectional view of a charging roller supporting portion, and (b) is a side view of a cleaning unit 9.

In Embodiment 1, the urging means 41 is constituted by the pressing spring 44 and the roller supporting member 42, but in this embodiment, an urging means 41 is constituted by a single part having elasticity. The urging means 41 is constituted by a spring wire material, and one end 41*d* thereof is fixed in a fixing hole 21*h* provided in a side surface of a cleaning frame 21. The one end 41*b* of the urging means 41 is fixed in the fixing hole 21*h* with respect to both of a rotational direction and a pulling-out direction (axial direction). The other end 41*b*, in the opposite side, of the urging means 41 which is a roller supporting portion is bent from an arm portion 41*a* toward a longitudinal center by 90 degrees. The one end 41*b* engages with a portion-to-be-supported 2*e* which is an inner peripheral surface of a hole 2*g* of the charging roller 2. An inner diameter of the portion-to-be-supported 2*e* is set so as to be slightly larger than a wire diameter of the urging means 41. Further, in a state in which the charging roller 2 contacts the photosensitive drum 1, the urging means 41 is disposed so that the arm portion 41*a* is flexed and generates a desired urging force (500 gf in this embodiment).

Thus, the urging means 41 is constituted by the single part including the arm portion 41*a* which is an elastic portion and which is swingable and including the one end 41*b* which is the roller supporting portion, so that it is possible to reduce the number of parts compared with the constitution in Embodiment 1 while achieving the effects obtained in Embodiment 1.

Embodiment 3

Figure 7:
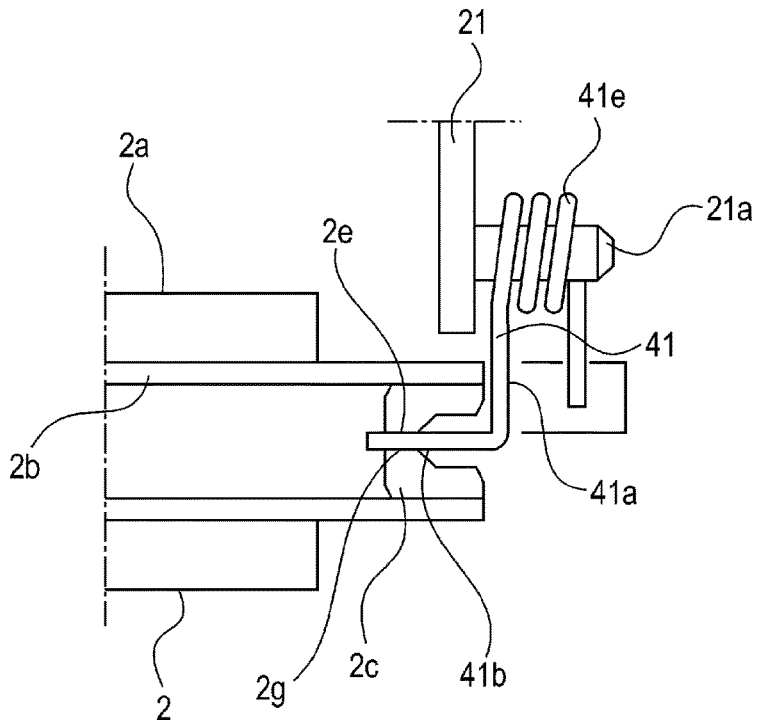
In FIG. 7, (a) is a sectional view of a charging roller supporting portion in Embodiment 3, and (b) is a side view of a cleaning unit in Embodiment 3.
Figure 7:
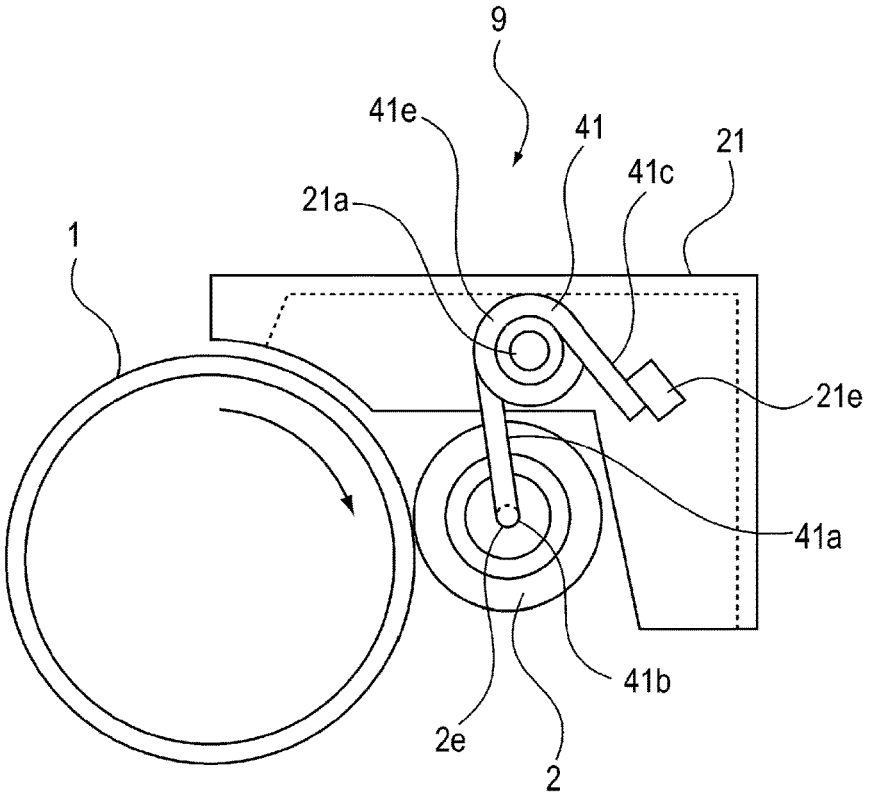

A constitution according to Embodiment 3 will be described based on FIG. 7. In FIG. 7, (a) is a sectional view of a charging roller supporting portion, and (b) is a side view of a cleaning unit 9.

In Embodiment 2, the urging means 41 is constituted by the spring wire material as the single member having the elasticity, but in this embodiment, an urging means 41 is constituted particularly by a torsion coil spring.

The urging means 41 includes a wire-wound portion 41*e* engaged with and locked by a spring-engaging boss 21*a* provided on a side surface of the cleaning frame 21. One end 41*b* of the urging means 41 which is a roller supporting portion is bent from an arm portion 41*a* in a direction parallel to a wire-wound shaft by 90 degrees and extends toward a longitudinal center. The spring engaging boss 21*a* is provided at a position where the arm portion 41*a* urges the charging roller 2 toward an axial center of the photosensitive drum 1. The one end 41*b* of the urging means 41 which is the roller supporting portion engages with a portion-to-be-supported 2*e* which is an inner peripheral surface of a hole 2*g* of the charging roller 2. An inner diameter of the portion-to-be-supported 2*e* is set so as to be slightly larger than a wire diameter of the urging means 41. Further, in a state in which the charging roller 2 contacts the photosensitive drum 1, the urging means 41 is disposed so that the wire-wound portion 41*e* is elastically deformed and generates a desired urging force (500 gf in this embodiment). Further, the other end 41*c* of the urging means 41 in a side opposite from the one end 41*b* is locked by a locking portion 21*e* provided in the cleaning frame 21.

Thus, the urging means 41 is constituted by the torsion coil spring, so that it is possible to reduce spring constant by providing the wire-wound portion compared with the constitution in Embodiment 2 while achieving the effects obtained in Embodiment 1. For that reason, it is possible to considerably suppress a manufacturing variation in spring force generating during use. The urging force can be further stabilized.

Embodiment 4

Figure 8:
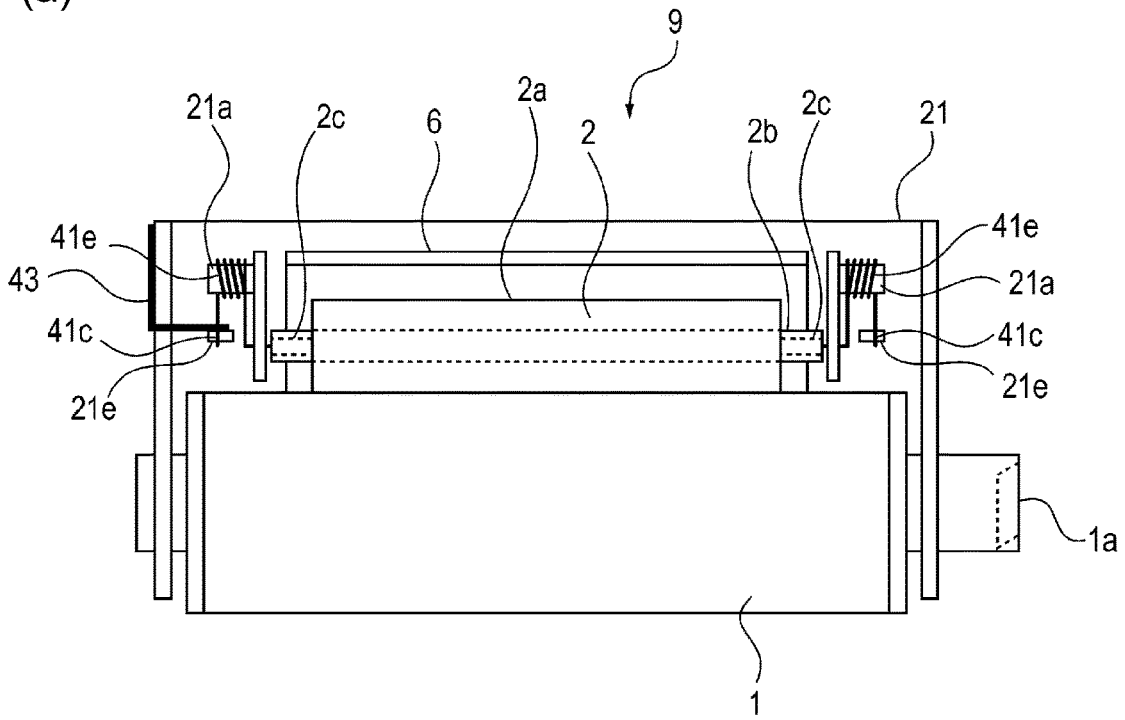
In FIG. 8, (a) is a front view of a cleaning unit in Embodiment 4, and (b) is a sectional view of a charging roller supporting portion in Embodiment 4.
Figure 8:
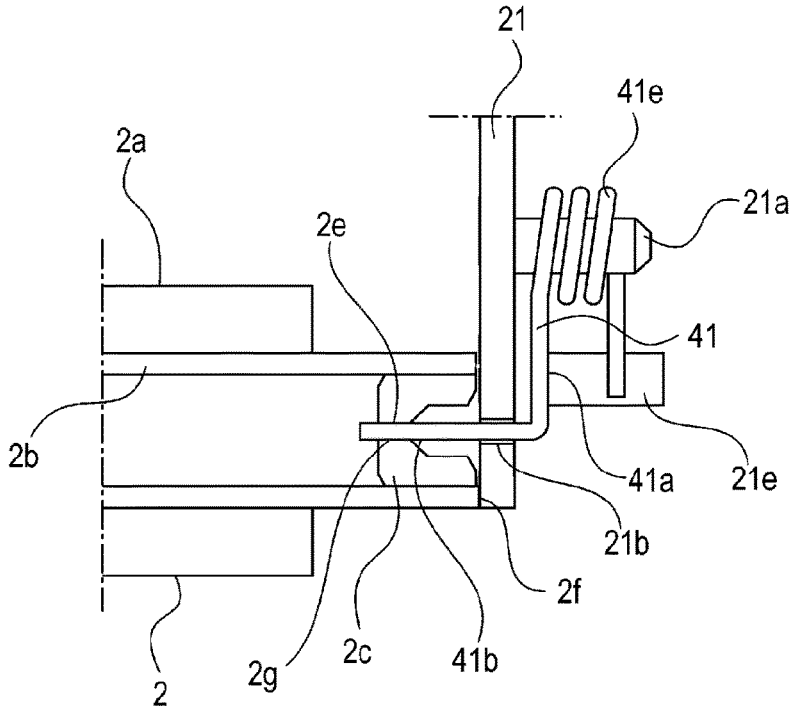
Figure 9:
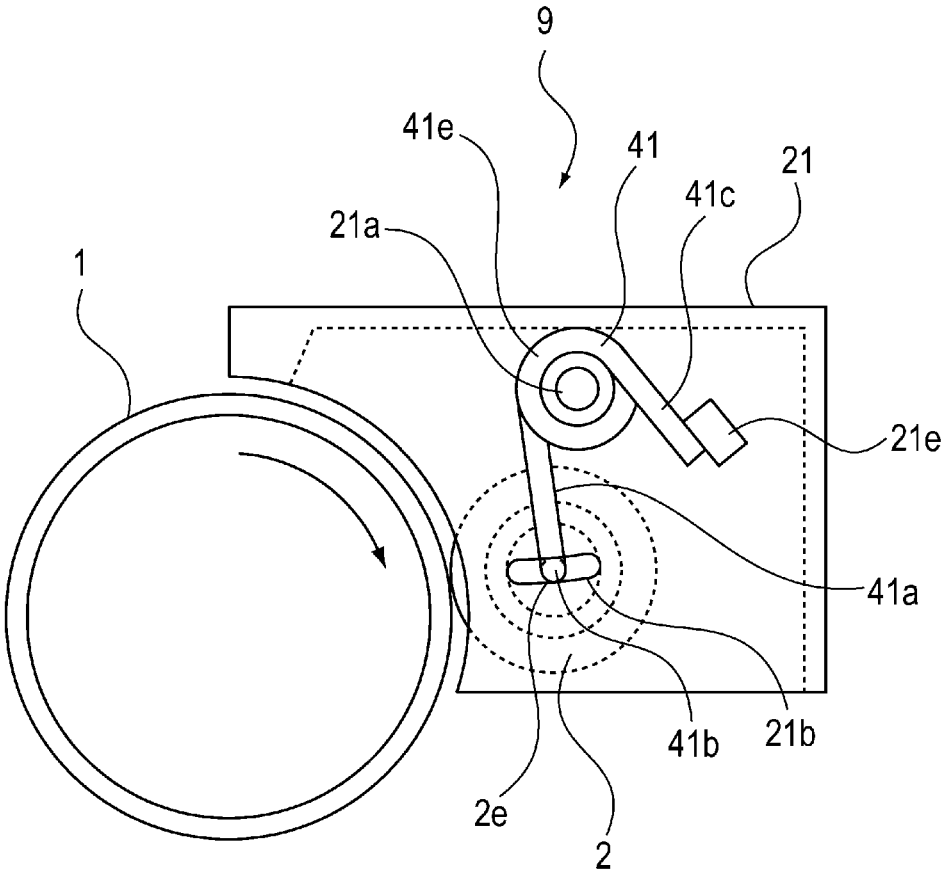
FIG. 9 is a side view of the cleaning unit in Embodiment 4.

A constitution according to Embodiment 4 will be described based on FIGS. 8 and 9. In FIG. 8, (a) is a front view of a cleaning unit 9, and (b) is a sectional view of a charging roller supporting portion. FIG. 9 is a side view of the cleaning unit 9.

In Embodiment 3, as the urging means 41, the torsion coil spring is used, but particularly in the case where the wire diameter is small, a size can be reduced, but on the other hand, a degree of flexure of the one end 41*b* which is a supporting portion for the charging roller 2 increases, so that there is a liability that a circumferential position of the charging roller 2 relative to the photosensitive drum 1 becomes unstable. In this embodiment, in view of the above liability, a constitution capable of alleviating the flexure of the one end 41*b* will be described. Particularly, as regards portions omitted from description, the portions are in accordance with the constitution in Embodiment 3.

As shown in (b) of FIG. 8, the one end 41*b* of the urging means 41 which is the roller supporting portion is bent from the arm portion 41*a* in the direction (axial direction) parallel to the wire-wound shaft by 90 degrees and penetrates through an elongated hole 21*b* toward the longitudinal center. Further, a portion in the neighborhood of a free end of the arm portion 41*a* engages with the portion-to-be-supported 2*e* which is the inner peripheral surface of the hole 2*g* of the charging roller 2 described above. The elongated hole 21*b* is, as shown in FIG. 9, slightly larger than the wire diameter of the urging means 41 with respect to a widthwise direction, and a longitudinal portion of the elongated hole 21*b* extends along a rotation locus of the arm portion 41*a*.

By thus employing the constitution, the elongated hole 21*b* supports a bending base portion between the arm portion 41*a* and the one end 41*b*, so that it is possible to stabilize the position of the charging roller 2 while limiting a fluctuation of the charging roller 2 with respect to a circumferential direction of the photosensitive drum 1.

(Translational Operation of Charging Roller)

Figure 10:
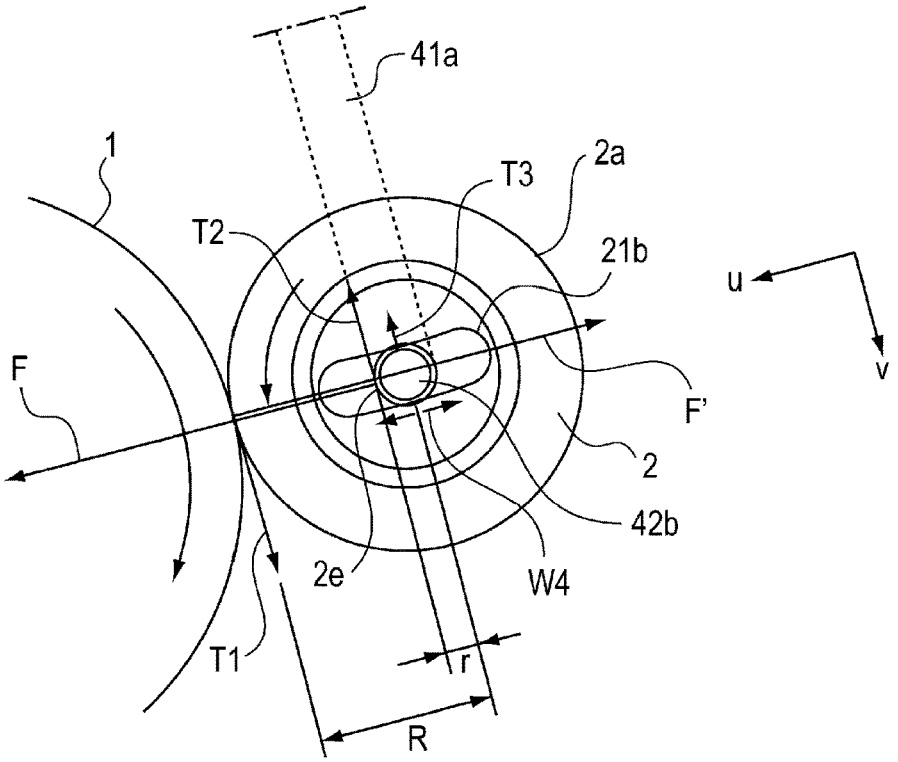
FIG. 10 is a schematic view showing forces acting on a charging roller in Embodiments 4 and 5.

In the constitution of this embodiment, a mechanism of translational followability of the charging roller 2 to the photosensitive drum 1 is different from that in Embodiments 1-3, and therefore, will be described below. Incidentally, the rotational followability of the charging roller 2 to the photosensitive drum 1 is the same in the constitutions of Embodiments 1-4 and will be omitted from description. In the following, description will be made by comparing constitutions of the comparison example (conventional constitution) and this embodiment with reference to (b) of FIG. 5 and FIG. 10. In FIG. 5, (b) is a schematic view showing forces exerted on the charging roller 102 in the comparison example, and FIG. 10 is a schematic view showing forces exerted on the charging roller 2 in this embodiment. In the figures, solid line arrows represent the forces exerted on the charging roller 2, and broken line arrows represent the forces exerted on the parts other than the charging roller 102. Incidentally, on the charging rollers 2 and 102, gravitation acts, but the gravitation equally acts on the charging rollers in this embodiment in the comparison example, and a functional effect is obtained irrespective of the direction of gravitation and therefor the gravitation is omitted from illustration.

In this embodiment, as shown in FIG. 10, on the charging roller 2, the frictional force T1 acts in the arrow v direction, and the frictional force T2 and a force T3 for supporting the charging roller 2 by the urging means 41 act in the direction opposite to the arrow v direction, and the frictional forces T1, T2 and the force T3 are balanced with each other. That is, the following formula 11 is satisfied.

$$T3=T1-T2 \quad \text{(formula 11)}$$

When the one end 41*b* of the urging means 41 which is the roller supporting portion is flexed by receiving the force in the arrow v direction, the one end 41*b* contacts the elongated hole 21*b*. The elongated hole 21*b* supports the one end 41*b* with the force T3. Then, between the one end 41*b* and the elongated hole 21*b*, a frictional force W4 proportional to the force T3 generates in the arrow u direction or a direction opposite to the arrow u direction. When a frictional coefficient is represented by 115, the frictional force W4 is represented by the following formula 12 (into which the formula 11 is substituted).

$$W4=\pm\mu5\times T3=\pm\mu5(T1-T2) \quad \text{(formula 12)}$$

The frictional forces of the charging roller 2 in the arrow u direction are compared with each other. The frictional force W1 in the comparison example is proportional to the sum of the forces T1 and T2 as shown in the formula 7, whereas the frictional force W4 in this embodiment is proportional to the difference between the forces T1 and T2 as shown in the formula 12. The frictional coefficients μ3 and μ5 can be made equal to each other by appropriately selecting the materials, and therefore in this case, it is assumed that μ3=μ5 holds. Then, it is clear that the frictional force W4 in this embodiment is remarkably smaller than the frictional force W1 in the comparison example. The low frictional force in the arrow u direction means nothing other than improvement in translational followability to the photosensitive drum 1 in the arrow u direction.

As described above, the elongated hole 21*b* for supporting the one end 41*b* which is the roller supporting portion is provided in the cleaning frame 21, whereby stability of the position of the charging roller 2 is further improved while achieving the effects obtained in Embodiment 1. As a result, charging non-uniformity of the photosensitive drum can be suppressed, so that formation of a higher-quality image can be realized.

Embodiment 5

Figure 11:
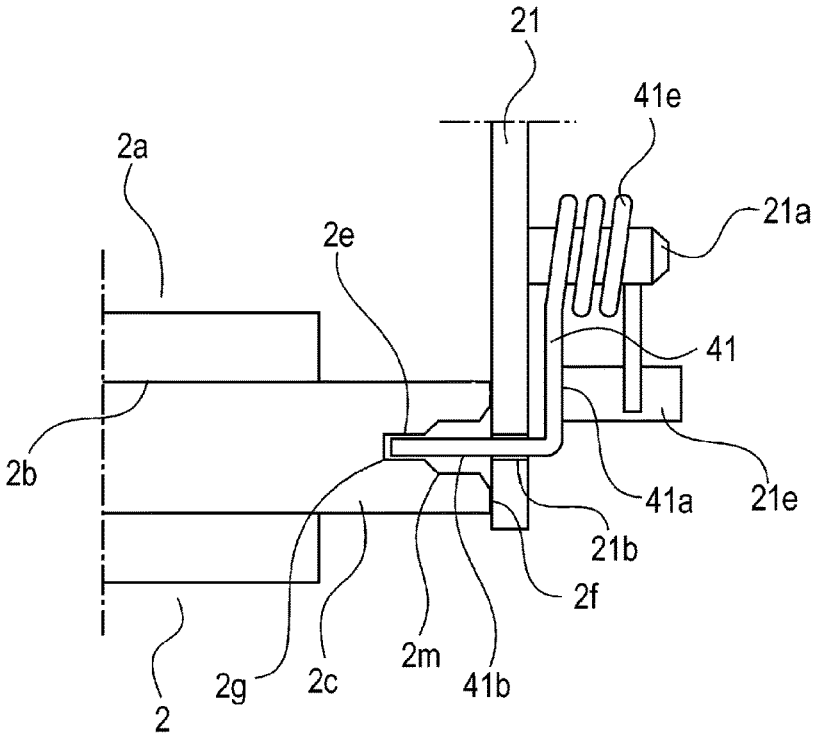
FIG. 11 is a sectional view of a charging roller supporting portion in Embodiment 5.

A constitution according to Embodiment 5 will be described based on FIG. 11. FIG. 11 is a sectional view of a charging roller supporting portion.

In this embodiment, as shown in FIG. 11, a constitution in which the cap 2*c* is not provided at a shaft end portion of the charging roller 2 and the urging means 41 is directly contacted to the charging roller 2 is employed.

In this embodiment, the core metal shaft 2*b* of the charging roller 2 is a solid metal shaft and is provided with a recessed portion (hole) 2*m* recessed from each of end portions in both sides toward a central side with respect to the axial direction. In a rear side of the recessed portion 2*m*, a small hole 2*g* having an inner diameter smaller than that of the recessed portion 2*m* is provided, and a portion-to-be-supported 2*e* is provided at an inner peripheral surface of the small hole 2*g*. An inner diameter of the portion-to-be-supported 2*e* is set so as to be slightly larger than a wire diameter of the urging means 41 formed with the torsion coil spring. The inner peripheral surface of the portion-to-be-supported 2*e* is finished finely in terms of surface roughness so that the inner peripheral surface of the portion-to-be-supported 2*e* is not abraded by being slid with the urging means 41. Mounting of the urging means 41 to the cleaning frame 21 is performed, similarly as in Embodiment 4, by engaging a wire-wound portion 41*e* with a spring-engaging boss 21*a* and by penetrating the one end 41*b*, which is the roller supporting portion, through the elongated hole 21*b*.

As described above, by forming the portion-to-be-supported 2*e* with the core metal shaft 2*b* of the charging roller 2, a manufacturing cost can be reduced by the absence of the member corresponding to the cap 2*c* while achieving the effects obtained in Embodiment 1.

Other Embodiments

In the above-described embodiments, the example in which the voltage applying device in the present invention is incorporated in the process cartridge was described, but the present invention is not limited thereto. For example, the voltage applying device in the present invention may also be incorporated in an image forming apparatus in which a cartridge type is not employed. Further, a minimum unit consisting only of the charging roller and the frame provided with the urging member may also be constituted so as to be detachably mountable to the process cartridge or the apparatus main assembly of the image forming apparatus.

In the above-described embodiments, as the roller for charging the member-to-be-charged, the charging roller 2 was described but the roller is not limited thereto. For example, even when the present invention is applied to the transfer roller 104 or the developing roller 5, a similar effect is achieved.

In the above-described embodiments, an example of the case where the transfer(-receiving) material P as the transfer receiving member onto which the toner image is transferred from the photosensitive drum 1 is the recording material such as paper or a sheet was described. However, the transfer receiving member may also be an endless belt such as the intermediary transfer belt onto which the toner image is transferred from the photosensitive drum 1.

In the above-described embodiments, a single process cartridge is used, but the number of the process cartridges used is not limited and may also be appropriately set as desired.

In the above-described embodiments, as the process cartridge detachably mountable to the apparatus main assembly of the image forming apparatus, the process cartridge integrally including the photosensitive drum and, as the process means actable on the photosensitive drum, the charging means, the developing means and the cleaning means was described. However, the process cartridge is not limited thereto. For example, the process cartridge may also be a process cartridge including not only the photosensitive drum but also either one of the charging means, the developing means and the cleaning means.

In the above-described embodiments, as the image forming apparatus, the printer is described, but the present invention is not limited thereto. For example, the image forming apparatus may also be other image forming apparatuses such as a copying machine, a facsimile machine and a multi-function machine having a combination of functions of these machines. By applying the present invention to voltage applying devices in these image forming apparatuses, similar effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

According to the present invention, it is possible to improve followability of a roller to a photosensitive member while ensuring flexural rigidity of the roller with an inexpensive constitution.

The invention claimed is:

1. A cartridge comprising:

a photosensitive member;

a roller actable on the photosensitive member and including a core metal shaft;

roller supporting portions for rotatably supporting the roller; and a regulating portion for regulating a position of the roller with respect to a longitudinal direction of the roller, wherein the roller supporting portions are provided so as to support a first end portion and a second end portion of the core metal shaft, respectively, with respect to a direction of a rotational axis of the roller, wherein the roller is further provided with cylindrical holes disposed at the first end portion and the second end portion of the core metal shaft with respect to the direction of the rotational axis and extending in the direction of the rotational axis with the rotational axis as a center, and wherein the roller is supported by the roller supporting portions at inner peripheral surfaces of the holes.

2. A cartridge according to claim 1, wherein the core metal shaft is a hollow shaft, and wherein the cartridge includes end portion members engaged with and fixed to the first end portion and the second end portion of the core metal shaft with respect to the direction of the rotational axis, and the holes are provided in the end portion members.

3. A cartridge according to claim 1, wherein the core metal shaft is a solid shaft, wherein the holes are formed at the first end portion and the second end portion of the core metal shaft with respect to the direction of the rotational axis and are recessed portions that are recessed from end portions thereof toward central sides thereof with respect to the direction of the rotational axis, wherein the holes are provided with small holes at the central sides of the recessed portions with respect to axial directions of the recessed portions, and inner diameters of the small holes are smaller than an inner diameters of the end portions of the recessed portions, and wherein the roller is supported by the roller supporting portions at inner peripheral surfaces of the small holes.

4. A cartridge according to claim 1, further comprising urging means for urging the roller toward the photosensitive member.

5. A cartridge according to claim 4, wherein the urging means is constituted by a single member having elasticity.

6. A cartridge according to claim 4, wherein the urging means is a torsion coil spring.

7. A cartridge according to claim 4, further comprising an energization member supplied with electric power from an energizing portion, wherein the energization member contacts the urging means and a voltage is applied to the roller through the urging means.

8. A cartridge according to claim 7, wherein with respect to the longitudinal direction, the energization member is provided at a side opposite from a side where a driving force is inputted to the photosensitive member.

9. A cartridge according to claim 8, wherein the roller includes a rotation shaft inclined relative to an axis of the photosensitive member as a center so that the side where the driving force is inputted to the photosensitive member is positioned upstream, with respect to a rotational direction of the photosensitive member, of the side where the energization member is provided.

10. A cartridge according to claim 1, wherein each of the roller supporting portions is provided with respect to an axial direction of the roller, and wherein the cartridge is provided with a hole, through which the roller supporting portion penetrates in the axial direction, for limiting a fluctuation of the roller with respect to a circumferential direction of the photosensitive member.

11. A cartridge according to claim 1, wherein the roller includes a coating layer for coating the core metal shaft, and wherein each of the inner peripheral surfaces is disposed at a position overlapping with the coating layer with respect to the direction of the rotational axis.

12. A cartridge according to claim 11, wherein the roller is a charging roller for electrically charging the photosensitive member.

13. A cartridge according to claim 11, wherein the roller is a developing roller for depositing toner on the photosensitive member.

14. A cartridge according to claim 11, wherein the roller is a transfer roller for transferring a toner image from the photosensitive member onto a toner image receiving member.

15. An image forming apparatus for forming an image on a recording material, the image forming apparatus comprising:

a photosensitive member;

a roller actable on the photosensitive member and including a core metal shaft;

roller supporting portions for rotatably supporting the roller; and a regulating portion for regulating a position of the roller with respect to a longitudinal direction of the roller, wherein the roller supporting portions are provided so as to support a first end portion and a second end portion of the core metal shaft, respectively, with respect to a direction of a rotational axis of the roller, wherein the roller is further provided with cylindrical holes disposed at the first end portion and the second end portion of the core metal shaft with respect to the direction of the rotational axis and extending in the direction of the rotational axis with the rotational axis as a center, and wherein the roller is supported by the roller supporting portions at inner peripheral surfaces of the holes.

16. An image forming apparatus according to claim 15, wherein the core metal shaft is a hollow shaft, and wherein a cartridge including the roller also includes end portion members engaged with and fixed to the first end portion and the second end portion of the core metal shaft with respect to the direction of the rotational axis, and the holes are provided in the end portion members.

17. An image forming apparatus according to claim 15, wherein the core metal shaft is a solid shaft, wherein the holes are formed at the first end portion and the second end portion of the core metal shaft with respect to the direction of the rotational axis and are recessed portions that are recessed from end portions thereof toward central sides thereof with respect to the direction of the rotational axis, wherein the holes are provided with small holes at the central sides of the recessed portions with respect to axial directions of the recessed portions, and inner diameters of the small holes are smaller than an inner diameters of the end portions of the recessed portions, and wherein the roller is supported by the roller supporting portions at inner peripheral surfaces of the small holes.

18. An image forming apparatus according to claim 15, further comprising urging means for urging the roller toward the photosensitive member.

19. An image forming apparatus according to claim 18, wherein the urging means is constituted by a single member having elasticity.

20. An image forming apparatus according to claim 18, wherein the urging means is a torsion coil spring.

21. An image forming apparatus according to claim 18, further comprising an energization member supplied with electric power from an energizing portion, wherein the energization member contacts the urging means and a voltage is applied to the roller through the urging means.

22. An image forming apparatus according to claim 21, wherein with respect to the longitudinal direction, the energization member is provided at a side opposite from a side where a driving force is inputted to the photosensitive member.

23. An image forming apparatus according to claim 22, wherein the roller includes a rotation shaft inclined relative to an axis of the photosensitive member as a center so that the side where the driving force is inputted to the photosensitive member is positioned upstream, with respect to a rotational direction of the photosensitive member, of the side where the energization member is provided.

24. An image forming apparatus according to claim 15, wherein each of the roller supporting portions is provided with respect to an axial direction of the roller, and wherein a cartridge, which includes the roller, is provided with a hole, through which the roller supporting portion penetrates in the axial direction, for limiting a fluctuation of the roller with respect to a circumferential direction of the photosensitive member.

25. An image forming apparatus according to claim 15, wherein the roller includes a coating layer for coating the core metal shaft, and wherein each of the inner peripheral surfaces is disposed at a position overlapping with the coating layer with respect to the direction of the rotational axis.

26. An image forming apparatus according to claim 25, wherein the roller is a charging roller for electrically charging the photosensitive member.

27. An image forming apparatus according to claim 25, wherein the roller is a developing roller for depositing toner on the photosensitive member.

28. An image forming apparatus according to claim 25, wherein the roller is a transfer roller for transferring a toner image from the photosensitive member onto a toner image receiving member.

* * * * *